US008899508B2

(12) United States Patent
Hjort et al.

(10) Patent No.: US 8,899,508 B2
(45) Date of Patent: Dec. 2, 2014

(54) DISPENSER FOR ROLL OF ABSORBENT PAPER TISSUE OR NONWOVEN MATERIAL

(75) Inventors: Erik Hjort, Borlänge (SE); Mats Lind, Vikmanshyttan (SE); Joakim Norin, Hägersten (SE); Marcus Kullman, Borlänge (SE); Ingemar Ekmefjord, Vikmanshyttan (SE)

(73) Assignee: SCA Hygiene Products AB, Göteborg (SE)

( * ) Notice: Subject to any disclaimer, the term of this patent is extended or adjusted under 35 U.S.C. 154(b) by 0 days.

(21) Appl. No.: 13/700,296

(22) PCT Filed: May 27, 2010

(86) PCT No.: PCT/SE2010/050574
§ 371 (c)(1),
(2), (4) Date: Dec. 17, 2012

(87) PCT Pub. No.: WO2011/149393
PCT Pub. Date: Dec. 1, 2011

(65) Prior Publication Data
US 2013/0105614 A1 May 2, 2013

(51) Int. Cl.
*B65H 20/02* (2006.01)
*B65H 16/10* (2006.01)
*A47K 10/36* (2006.01)

(52) U.S. Cl.
CPC ..... *B65H 16/106* (2013.01); *A47K 10/36* (2013.01)
USPC ..... 242/564.4

(58) Field of Classification Search
CPC ..... A47K 10/32; A47K 10/34; A47K 10/36; B65H 16/005; B65H 16/02; B65H 16/021; B65H 16/06; B65H 75/08; B65H 2301/41342
USPC ..... 242/564, 564.1, 564.2, 564.4, 564.5, 242/565
See application file for complete search history.

(56) References Cited

U.S. PATENT DOCUMENTS 469,607 A * 2/1892 Stevenson ..... 242/564.5
3,672,552 A 6/1972 Krueger et al.

(Continued)

OTHER PUBLICATIONS

International Search Report (PCT/ISA/210) issued on Jan. 25, 2011, by the Swedish Patent Office as the International Searching Authority for International Application No. PCT/SE2010/050574.

(Continued)

*Primary Examiner* — William A Rivera
(74) *Attorney, Agent, or Firm* — Buchanan Ingersoll & Rooney

(57) ABSTRACT

A dispenser for web of absorbent paper, tissue or nonwoven material is provided. The dispenser has a housing with a holder arrangement for receiving the roll, the holder arrangement providing a roll rotational axis about which the roll is arranged to rotate when dispensing the web. The dispenser has a drive roller extending in a direction substantially parallel to the roll rotational axis. The dispenser has an engaging roller extending substantially parallel to the drive roller. The drive roller and the engaging roller are arranged so as to define a dispensing passage therebetween for the web. The roll of web is arranged to be biased against the drive roller. The drive roller is arranged such that a dispensing end of the web is adapted to be led from the roll over the drive roller through the dispensing passage and to frictionally engage with the drive roller and the engaging roller.

17 Claims, 4 Drawing Sheets

(56) References Cited

U.S. PATENT DOCUMENTS

| | | | | |
|---|---|---|---|---|
| 5,526,973 | A | 6/1996 | Boone et al. | |
| 6,179,243 | B1 * | 1/2001 | Granger | 242/564.5 |
| 6,684,751 | B2 | 2/2004 | Lewis et al. | |
| 6,997,094 | B2 * | 2/2006 | Granger | 242/564.5 |
| 7,036,764 | B2 * | 5/2006 | Granger et al. | 242/564.5 |
| 7,168,653 | B2 | 1/2007 | Omdoll et al. | |
| 2004/0256516 | A1 * | 12/2004 | Granger | 242/564.5 |
| 2013/0161346 | A1 * | 6/2013 | Wolme et al. | 242/562 |

OTHER PUBLICATIONS

Written Opinion (PCT/ISA/237) issued on Jan. 25, 2011, by the Swedish Patent Office as the International Searching Authority for International Application No. PCT/SE2010/050574.

International Preliminary Report on Patentability (PCT/IPEA/409) issued on Sep. 3, 2012, by the Swedish Patent Office as the International Searching Authority for International Application No. PCT/SE2010/050574.

* cited by examiner

DISPENSER FOR ROLL OF ABSORBENT PAPER TISSUE OR NONWOVEN MATERIAL

TECHNICAL FIELD

The present invention relates to a dispenser for a roll of absorbent paper, tissue or nonwoven material according to the precharacterizing portion of claim 1.

BACKGROUND

Rolls of absorbent paper, tissue or nonwoven material, for e.g. wiping purposes, are often mounted in a dispenser, from which sheets of web of the absorbent paper, tissue or nonwoven material may be dispensed by a user at a dispensing end of the absorbent paper, tissue or nonwoven material. The web of absorbent paper, tissue or nonwoven material on the roll may be provided with perforations or may be without perforations. Any perforations are designed to facilitate separating a sheet from the web but this normally results in the material breaking at every perforation. The user sometimes needs a long section of web and sometimes a short section of web.

A dispenser has a dispensing opening, or dispensing passage, through which the web of absorbent paper, tissue or nonwoven material is dispensed. In some types of dispensers, a user grasps and pulls on a dispensing end of the web from the roll to feed out a desired amount of web from the dispenser. In other types of dispensers a user operates a handle to feed out a desired amount of web from the dispenser. Often the dispensing opening or dispensing passage of a dispenser is provided with some kind of arrangement for facilitating tearing off of the web, such as serrated edge. The arrangement for facilitating tearing off may be utilized for non-perforated as well as perforated web.

U.S. Pat. No. 5,526,973 discloses a flexible sheet dispenser for sequentially dispensing web material from a primary web roll and a reserve web roll. The dispenser has a feed nip defined by two feed rollers, which rollers are adapted for achieving the sequential dispensing from the two rolls. The feed rollers are provided with spaced grooves between annular ribs. One of the feed rollers is movably arranged. When web is present in the feed nip, the rollers are separated to define the feed nip. In the feed nip the web material is flat. When no web is present, the feed nip is closed by the grooves and ribs of the feed rollers intermesh as the movable feed roller has moved towards the other feed roller to signal that no web is left on the stub roll is left, and automatic change of roll to dispense web from will occur.

U.S. Pat. No. 7,168,653 discloses a wall mounted dispenser wherein a roll of sheet material is arranged above a drive roller to be biased by means of gravity towards and against a drive roller of a feeding mechanism. The drive roller and an idle roller cooperate to form a pressure nip. The drive roller is rotated by a handle to pull on sheet material threaded into the pressure nip. The handle has to be operated one or more times to feed out a desired amount of sheet material. A blade is provided for separating fed out sheet material from the roll.

SUMMARY

An object of the present invention is to provide a dispenser which facilitates grasping and tearing off of a web from a roll of absorbent paper, tissue or nonwoven material, at least to a certain extent.

According to an aspect of the invention, the object is achieved by a dispenser for web of absorbent paper, tissue or nonwoven material in the form of a roll. The dispenser comprises a housing with a holder arrangement for receiving the roll. The holder arrangement provides a roll rotational axis about which the roll is arranged to rotate when dispensing the web. The dispenser further comprises a drive roller extending in a direction substantially parallel with the roll rotational axis. The drive roller is adapted to abut the roll to control the dispensing of the web and to rotate substantially at the same peripheral speed as the roll when web is dispensed. Further, the dispenser comprises an engaging roller extending substantially parallel with the drive roller. The drive roller and the engaging roller are arranged so as to define a dispensing passage therebetween for the dispensing of the web. The dispenser is adapted for a user to grasp, and pull on, a dispensing end of the web to dispense a length of web from the roll. The roll is arranged to be biased against the drive roller by means of at least one spring to frictionally engage with the drive roller. The drive roller is arranged such that the dispensing end is adapted to be led from the roll over the drive roller. The engaging roller causes the dispensing end to frictionally engage with the drive roller and the engaging roller in dispensing passage such that the dispensing is controlled by an interaction between the dispensing end, the drive roller, and the engaging roller as the drive roller and the engaging roller are rotated by the dispensing end when the user pulls on the dispensing end.

Since the drive roller controls the rotation of the roll when the web is dispensed and the dispensing end of the web is dispensed over the drive roller through the dispensing passage and the engaging roller ensures a frictional engagement between the dispensing end of the web and the drive roller and the engaging roller, conditions for the web to be torn off outside the dispensing passage are improved. This is achieved because stretching of the web will thus take place outside of the dispensing passage and the web will thus break outside the dispensing passage. Accordingly, the dispensing end of the web of the absorbent paper, tissue or nonwoven material is available for easy grasping when a next sheet is to be torn from the roll. Also, since in the dispensing passage the drive roller and engaging roller are rotated by the dispensing end of the web, pulled on by a user, the frictional engagement between the web and the drive roller and, due to the biasing of the roll against the drive roller, the pulling force exerted by the user is translated into the rotation of the roll. Thus a user may dispense a desired length of web from a roll of perforated web before tearing off the desired length of web. As a result, the above mentioned object is achieved.

Biasing of the drive roller by means of the at least one spring ensures that the roll is biased against the drive roller with a needed force independent of the amount of absorbent paper, tissue or nonwoven material on the roll. Biasing of the roll against the drive roller may be further supported by means of gravity. In a portable dispenser the spring will ensure the biasing independent of how the dispenser is placed, e.g. when it is placed on a slanting surface.

According to example embodiments a peripheral surface of the engaging roller will be arranged to be in contact only with the dispensing end of the web. The engaging roller is not in contact with the drive roller. Thus, only the contact between the web and the engaging roller, will cause the engaging roller to rotate when paper, tissue or nonwoven material is dispensed from the roll.

According to example embodiments the housing may comprise a first dispensing opening and the drive roller and the engaging roller may be arranged in the housing such that the dispensing passage may be arranged in, or in direct connection with, i.e. in a vicinity of, the first dispensing opening.

According to example embodiments, the dispensing passage may be a friction nip. The nip may be achieved by the web being frictionally engaged with both the drive roller and the engaging roller with the rollers arranged at a distance from each other. This may be achieved by a non-linear dispensing passage.

According to preferred example embodiments the drive roller and the engaging roller each comprise several longitudinal sections having different diameters. The dispensing passage is defined between the sections having different diameters.

According to example embodiments the drive roller and the engaging roller may be arranged such that a small diameter longitudinal section of the drive roller is opposite to a large diameter longitudinal section of the engaging roller and a large diameter longitudinal section of the drive roller is opposite to a small diameter longitudinal section of the engaging roller, and wherein the drive roller and the engaging roller are arranged at a distance from each other such that the passage opening defined between the rollers is undulated. In this manner, due to the undulated passage opening, the dispensing end of the web will be in contact with both the drive roller and the engaging roller. In such an undulated passage opening, the drive roller and the engaging roller may be arranged at a distance from each other. Thanks to the undulated passage opening, it may be ensured that the dispensing end of the web from the roll is in contact with both the drive roller and the engaging roller in the dispensing passage. Also due to the undulated passage opening, a pulling force exerted substantially straight out from the dispensing passage by a user at the dispensing end of the web is distributed evenly over a central portion of the web. Accordingly, the web will not break even if perforated. When the user pulls on the web at an angle with the dispensing passage, the web weakened by a perforation will break along a perforation, starting at one side of the web.

According to example embodiments the longitudinal sections of different diameters of the drive roller or the engaging roller may be of the same widths, or of different widths. The undulations of the passage opening may thus be provided with a suitable shape. Further, the distance between a small diameter longitudinal section of one of the rollers and a large diameter longitudinal section of the other roller may be different in different positions along the two rollers. The undulations of the passage opening may be varied along the rollers in this manner. Also, the large diameter longitudinal sections of the rollers may be of different diameters, as too may be the small diameter longitudinal sections. Again, the undulations of the passage opening may be varied along the rollers also in this manner. By varying the undulations over the width of the dispensing passage, the frictional engaging of the web with the rollers may be varied over the width of the dispensing passage. These different design options may be utilized for adapting a dispensing passage for a particular kind of paper, tissue or nonwoven material. Rounded or chamfered outer edges of the large diameter longitudinal sections of the rollers are preferred. This will be more gentle to the web and provided a larger contact area for the web than if sharp outer edges (such 90 degree corners) of the large diameter longitudinal sections of the rollers would be provided. Also, the design options may be utilized for distributing a pulling force evenly over a width of the web when a user pulls on the web in a generally outward direction from the dispensing passage, and to concentrate a sidewardly directed pulling force onto a side of the web and a perforation of the web.

According to example embodiments the drive roller at its two outer ends may comprise an outer surface portion with a lower coefficient of friction than the coefficient of friction of a central surface portion of the drive roller. This may improve guiding of the dispensing end of the web over the drive roller. The dispensing end of the web is intended to slide over the outer surface portion in a direction parallel with the roll rotational axis to allow the web to follow the undulations of the passage opening. The coefficient of friction of an outer surface portion may be for instance at least 25% lower than then than the coefficient of friction of the central surface portion of the drive roller.

According to example embodiments the drive roller and/or the engaging roller may comprise an outer surface portion made from a rubber or rubberlike material. This may serve as a manner of achieving suitable friction between the drive roller and/or engaging roller and the web.

According to example embodiments the drive roller may extend over a distance parallel with the roll rotational axis shorter than a width of the roll. This may be a part of collecting of the web from the width of the roll to a width of the first dispensing opening.

According to example embodiments the first dispensing opening, in a direction parallel with the roll rotational axis, may be narrower than a width of the roll. In this manner a dispensing end of the web may be easily grasped. Also, a pulling force may be evenly distributed over the width of the web, since the point of application of the force will be concentrated to a smaller portion of the roll width and make it less likely that a side of the web is unintentionally subject to the pulling force. If combined with a drive roller of smaller width than the roll, the narrow dispensing opening may direct the web over the drive roller.

According to example embodiments the drive roller and/or the engaging roller may be provided with a one-way bearing for controlling a direction of rotation of the drive roller and/or the engaging roller. In this manner the rollers may rotate in one direction only, i.e. the dispensing direction. Due to the frictional engagement between the roll of absorbent paper, tissue or nonwoven material and the drive roller, the one-way bearing may prevent rotation of the roll in a direction opposite to the dispensing direction.

According to example embodiments the drive roller may be provided with a braking arrangement for controlling a speed of rotation of the drive roller to prevent overspin of the roll. In this manner, due to the friction engagement between the roll of absorbent paper, tissue or nonwoven material and the drive roller, such braking may prevent or considerably reduce free rotation of the roll in the dispensing direction. Also, the braking arrangement may improve conditions for the web to be torn off outside the dispensing passage.

According to example embodiments the housing may be provided with a second dispensing opening arranged downstream in a direction of dispensing at a distance from the first dispensing opening. The distance should be small enough to allow a user to grasp a dispensing end of the web at the dispensing passage.

According to example embodiments the second dispensing opening is provided in a lid of the housing. The lid may protect the first dispensing opening, for instance against splashing liquids. The distance between the lid and a remainder of the housing should be large enough to created a space allowing the dispensing end of the web to be arranged between the lid and the remainder of the housing.

According to example embodiments the dispenser may be a portable dispenser. The housing of the dispenser may be provided with a carrying arrangement, for instance in the form of a handle. The housing of the dispenser may enclose the roll of absorbent paper, tissue or nonwoven material to protect it from outside influences. In a portable dispenser, it may be advantageous to provide a dispensing passage according to any of the example embodiments to ensure that a free end of the web is graspable without having to open the dispenser. Since a portable dispenser may be carried around and placed on differently slanting surfaces, the one-way bearing as mentioned above and/or a braking arrangement of the drive roller combined with the roll being biased against the drive roller may ensure that it is prevented that the dispensing end of the web is withdrawn into the dispenser out of reach for a user during the handling of the dispenser, and that the web is not unintentionally dispensed from the roll.

Further features of, and advantages with, the present invention will become apparent when studying the appended claims and the following description. Those skilled in the art will realize that different features of the present invention may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

The present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout.

Well-known functions or constructions may not be described in detail for brevity and/or clarity.

Figure 1:
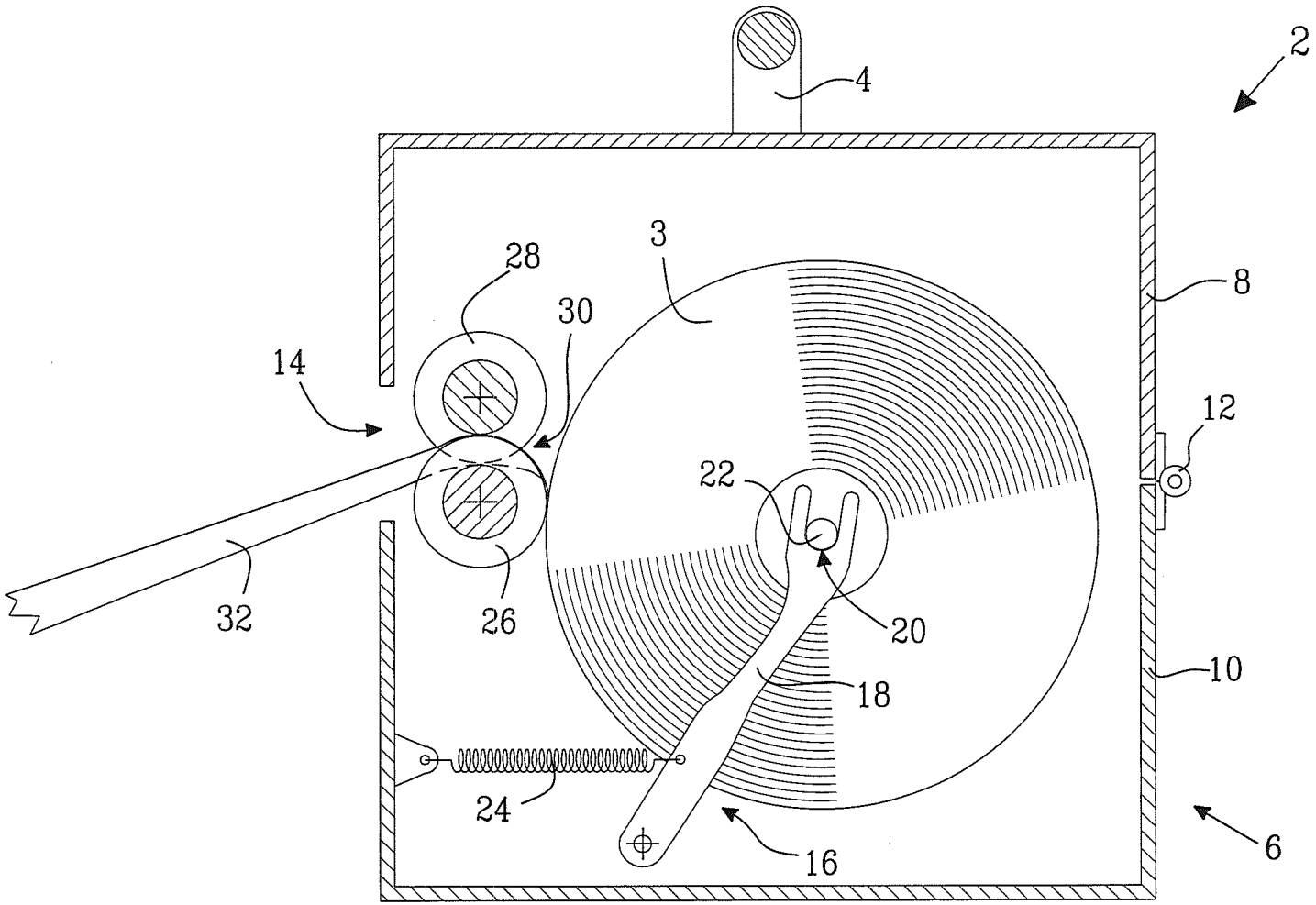
FIG. 1 illustrates schematically a cross section of a dispenser for web of absorbent paper, tissue or nonwoven material in the form of a roll according to example embodiments.

FIG. 1 illustrates schematically a cross section of a dispenser 2 for web of absorbent paper, tissue or nonwoven material in the form of a roll 3 according to example embodiments. The dispenser 2 is portable and is provided with a handle 4 to facilitate carrying or suspending the dispenser 2. The dispenser 2 comprises a housing 6 with an upper housing portion 8 and a lower housing portion 10, which are shown in a closed position. The housing portions 8, 10 are connected to each other at one end by means of a hinge 12. Opposite to the first hinge 10 there is formed a first dispensing opening 14 between the upper and lower housing portions 8, 10. In the illustrated position, the upper housing portion 8 extends partially around the roll 3, at least when it is a full roll 3.

The housing 6 is provided with a holder arrangement 16 for the roll 3. The holder arrangement 16 comprises an arm 18 with a seat 20 for an axle 22 about which the roll 3 rotates. The axle 22 may be arranged in a hole of a core of the roll 3 and may be formed by for instance a rod or by two separate inserts, one on each side of the roll 3. The arm 18 is pivotally connected with the housing 6 at an end of the arm 18 opposite to the seat 20. A spring 24 biases the arm 18 and the roll 3 towards the first dispensing opening 14. At an opposite end of the roll 3 (not shown in FIG. 1) the holder arrangement 16 is provide with a corresponding arm/spring system, a pivotable arm only or other devices for moving the axle 22 towards the dispensing opening 14. A roll rotational axis of the roll coincides with the axle 22. The illustrate spring 24 is a tension spring. Other spring types may alternatively be used for biasing the roll 3, such as a pressure spring or a torsion spring.

The dispenser 2 further comprises a drive roller 26 and an engaging roller 28 arranged in the housing 6 in close proximity to the first dispensing opening 14. Between the drive roller 26 and the engaging roller 28 there is defined a dispensing passage 30 through which web of paper tissue or nonwoven material from the roll 3 is dispensed by a user. The rollers 26, 28 are arranged such that a dispensing end 32 of the web from the roll 3 is in contact with both rollers 26, 28. The rollers 26, 28 suitably have an outer surface with a high friction coefficient, e.g. made from a rubber or rubberlike material. The roll 3, by means of the arm 18 and the spring 24, is biased against the drive roller 26. The drive roller 3 is thus frictionally engaged with the roll 3. Accordingly, when a user grasps and pulls on the dispensing end 32 of the web, the rotation of the drive roller 26 is transferred to the roll 3. Thus, the peripheral speed of the drive roller 26 and the roll 3 is the same.

Figure 2:
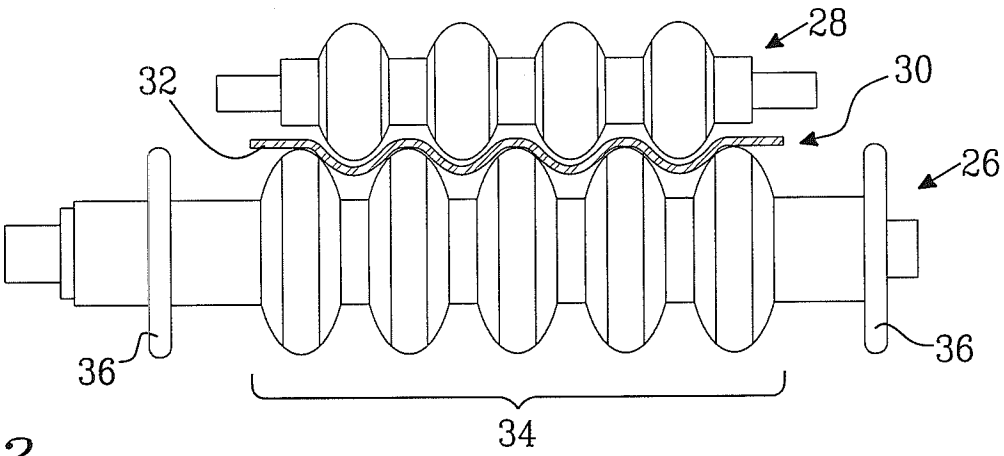
FIG. 2 illustrates exemplary embodiments of a drive roller and an engaging roller of a dispenser for web of absorbent paper, tissue or nonwoven material in the form of a roll.

FIG. 2 illustrates exemplary embodiments of a drive roller 26 and an engaging roller 28 of a dispenser for web of absorbent paper, tissue or nonwoven material in the form of a roll. The drive roller 26 and the engaging roller 28 each are provided with sections of small diameters and sections with large diameters. The drive roller 26 and the engaging roller 28 are arranged in relation to each other such that a small diameter longitudinal section of the drive roller 26 is opposite to a large diameter longitudinal section of the engaging roller 28, and a large diameter longitudinal section of the drive roller 26 is opposite to a small diameter longitudinal section of the engaging roller 28. In this regard, the large diameter longitudinal section of the drive roller may protrude into a space between two adjacent large diameter longitudinal sections of the engaging roller. And, the large diameter longitudinal section of the engaging roller may protrude into a space between two adjacent large diameter longitudinal sections of the drive roller. Between the rollers 26, 28 a dispensing passage 30 for the web is defined. The rollers 26, 28 are arranged at such a distance from each other that the outer portions of the large diameter sections of the rollers 26, 28 overlap seen in a direction along the axes of the rollers 26, 28 (i.e. a direction parallel to the axes of the rollers 26, 28 in FIG. 2). Due to this overlapping of the rollers 26, 28, the dispensing passage 30 is undulated.

In such an undulated passage opening 30, the dispensing end 32 of the web is in contact with both the drive roller 26 and the engaging roller 28. Again, the drive roller 26 and the engaging roller 28 have an outer surface with a high coefficient of friction. Accordingly, as the web is dispensed both the drive roller 26 and the engaging roller 28 will be rotated by the web. Since the web is in contact with both the drive roller 26 and the engaging roller 28 and due to the high coefficient of friction, the dispensing passage 30 is a friction nip. In the undulated dispensing passage 30, the close distance between the engaging roller 28 and the drive roller 26 ensures that the engaging roller 28 presses the web against the drive roller 26 such that both rollers 26, 28 are rotated as web is dispensed. An elastic paper, tissue or nonwoven material contributes to a sure engagement between the web and the rollers 26, 28. For a soft and less elastic web material the distance between the rollers 26, 28 may be decreased and/or the steepness of the undulations may be increased to ensure a sure engagement between the web and the rollers 26, 28. Alternatively, or in addition, rollers 26, 28 with a higher coefficient of friction may be used with less elastic web material.

A roll of paper, tissue or nonwoven material (not shown in FIG. 2) may be wider than the passage opening 30. To make the wide web from the roll pass easily into the passage opening 30 the drive roller 26 may be provided at its ends with sections having a lower coefficient of friction than a central section 34 of the drive roller 26. In these example embodiments these sections are constituted by large diameter discs 36 at the ends of the drive roller 26 made from a low friction material, for example of a plastic material.

Figure 3:
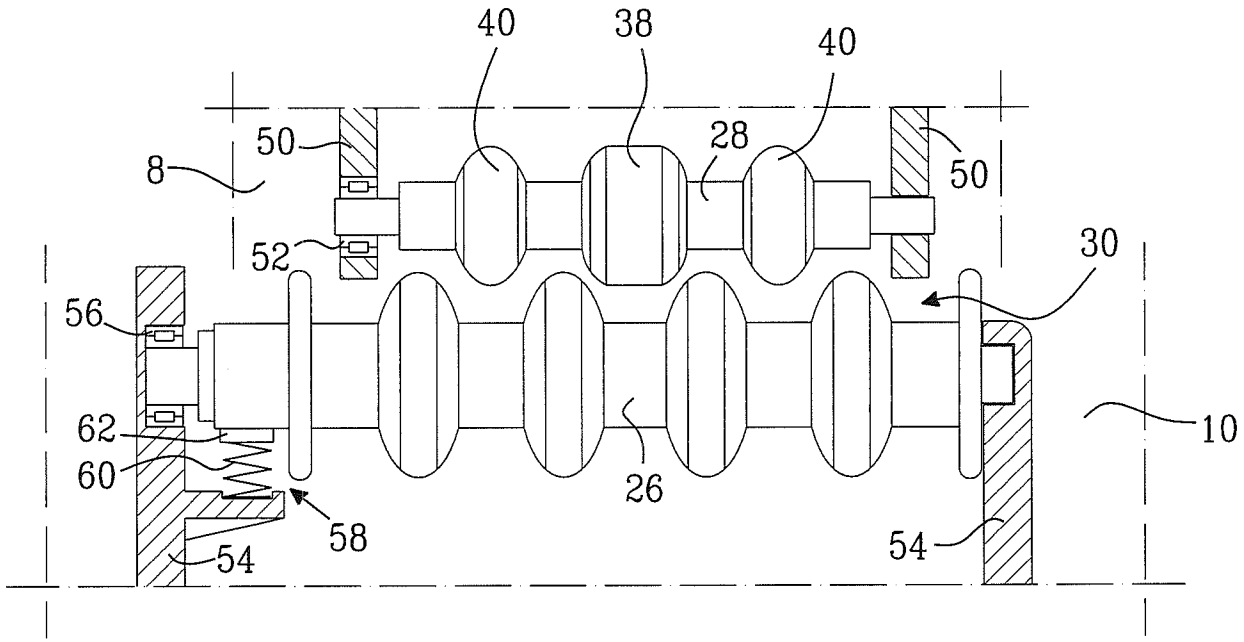
FIG. 3 illustrates schematically exemplary embodiments of a drive roller and an engaging roller arranged in a housing of a dispenser for web of absorbent paper, tissue or nonwoven material in the form of a roll.

FIG. 3 illustrates schematically exemplary embodiments of a drive roller 26 and an engagement roller 28 arranged in a housing of a dispenser for web of absorbent paper, tissue or nonwoven material in the form of a roll. The roll of paper tissue or nonwoven material (not shown in FIG. 3) is biased against the drive roller 26 for frictional engagement therebetween. Again, an undulated dispensing passage 30 is defined between different diameter longitudinal sections of the rollers 26, 28, which rollers 26, 28 have a high coefficient of friction at least at their central portions to ensure good contact between the web and the rollers 26, 28.

The engaging roller 28 has large diameter longitudinal sections of two different widths. A middle large diameter section 38 is wider than each of two outer large diameter sections 40. In this manner the shape of the undulations of the dispensing passage 30 are differently shaped at the centre of the dispensing passage 30 than at the outer sides of the dispensing passage 30. At the centre of the dispensing passage 30 the dispensing passage 30 is narrower than at the outer sides thereof, leading to steeper undulations at the centre than at the outer ends. Thus, the friction nip effect may be greater.

The engaging roller 28 is attached to an upper portion 8 of the housing. Wall sections 50 of the upper housing portion 8 are provided with seats for rotational supporting of the engaging roller 28. One of the seats is provided with a one-way bearing 52, such as the INA Drawn cup roller clutches HF0612. The one-way bearing 52 is arranged such that the engaging roller 28 only can rotate in a dispensing direction of the web. At the seat opposite to the one-way bearing 52, the engaging roller 28 may be supported with a slightly pinching fit such that the engaging roller 52 cannot rotate freely. The pinch fit seat forms a braking arrangement for controlling the rotation of the engaging roller 28. Frictional engagement of the web being pulled through the dispensing passage 30 in the dispensing direction will overcome the drag of the pinching fit to rotate the engaging roller 28.

The drive roller 26 is attached to a lower portion 10 of the housing. Wall sections 54 of the lower housing portion 10 are provided with seats for rotational supporting of the drive roller 26. One of the seats is provided with a one-way bearing 56, such as the INA Drawn cup roller clutches HF0612. The one-way bearing 56 is arranged such that the drive roller 26 only can rotate in the dispensing direction. One of the walls 54 is provided with a braking arrangement 58, comprising a spring 60 and a friction pad 62, which is lightly pressed against the drive roller 26 by the spring 60. The drive roller 26 is prevented from rotating freely by the braking arrangement 58. Alternatively, a braking arrangement may be formed at the seat opposite to the one-way bearing 56, where the drive roller 26 may be supported with a slightly pinching fit. Frictional engagement of the web being pulled through the dispensing passage 30 in the dispensing direction will overcome the drag of the braking arrangement 58 to rotate the drive roller 26.

Arranging the engaging roller 28 in the upper housing portion 8 and the drive roller 26 in the lower housing portion 10 enables easy loading of the dispenser with a roll of absorbent paper, tissue or nonwoven material. The two housing portions 8, 10 are opened, a roll is placed in the dispenser, a dispensing end of the web is placed onto the drive roller 26 and out through a dispensing opening, and as the two housing portions 8, are closed, the engaging roller 28 is again arranged close to the drive roller 26 to form the undulated dispensing passage 30 with the dispensing end of the web arranged therein.

Since the drive roller 26 is frictionally engaged with the roll and the drive roller 26 is prevented from freely rotating by the braking arrangement 58, the roll is prevented from rotating after a user stops pulling on the dispensing end of web from the roll, i.e. only the desired amount of paper, tissue or nonwoven material is dispensed, in other words, so called "overspin" of the roll is prevented. When the web is perforated to facilitate tearing off separate sheets of web, dispensing is facilitated by improving the reliability of having a sheet separate from the web outside the dispensing passage seen in the dispensing direction. Further, a user may extract a desired number of sheets in a row before separating them from the web of the roll. This is done by a user exerting a pulling force in a general direction outwardly from the dispensing passage 30 to extract the desired number of sheets and then apply a pulling force in a sideward direction of the dispensing passage 30 to separate the desired number of sheets from the roll in the nearest or next perforation. Pulling outwardly from the dispensing passage 30 applies a symmetrical force on the web, whereas pulling in a sideward direction will concentrate the pulling force to a side of the web. Accordingly, the web will break from a side opposite to the sideward direction.

Figure 4:
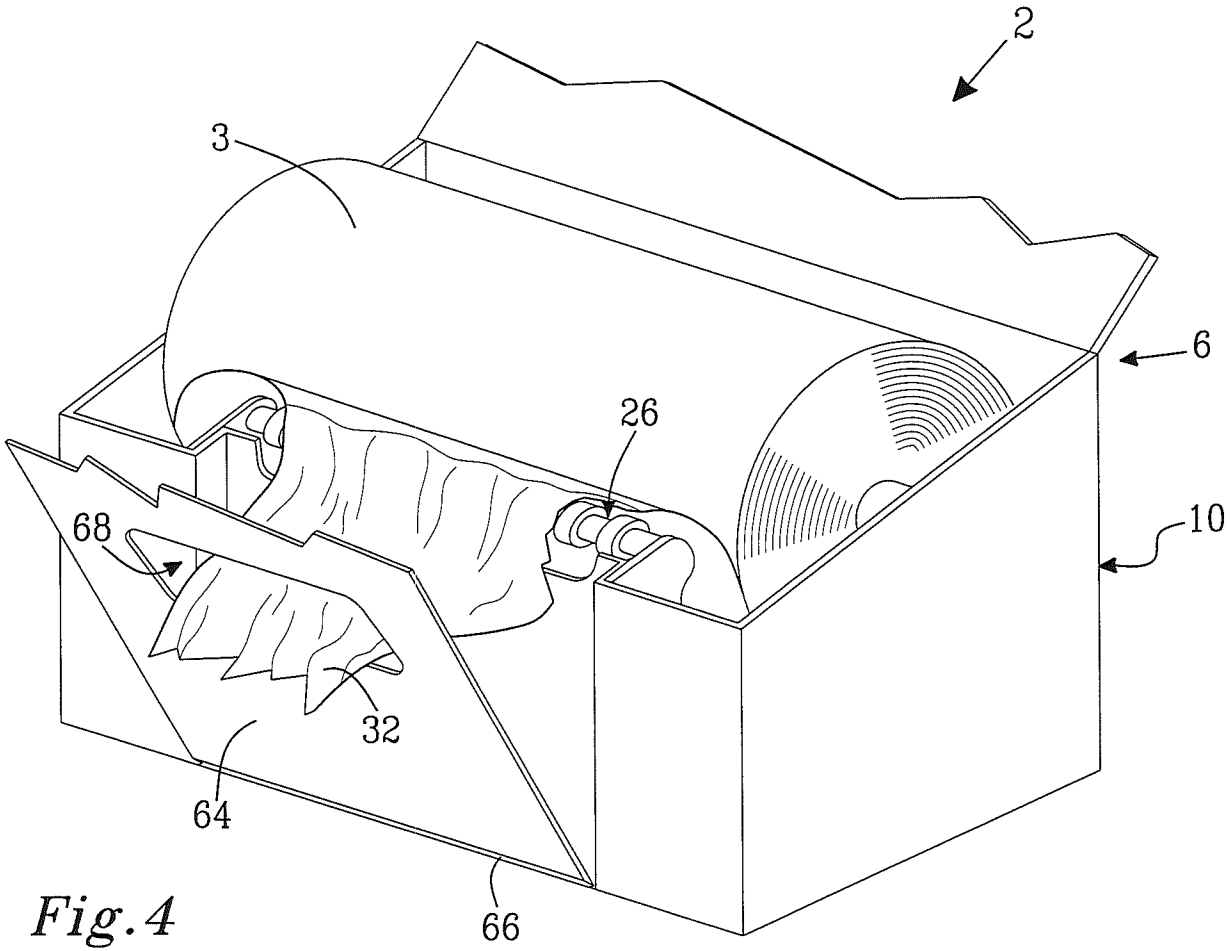
FIG. 4 illustrates schematically a perspective view of a lower housing portion of a housing of a dispenser for web of absorbent paper, tissue or nonwoven material in the form of a roll according to example embodiments.

FIG. 4 illustrates schematically a perspective view of a lower housing portion 10 of a housing 6 of a dispenser 2 for web of absorbent paper, tissue or nonwoven material in the form of a roll 3 according to example embodiments. The dispenser 2 may be mounted to a wall or similar fixed structure. An upper housing portion of the housing 6 has been omitted in FIG. 4. A drive roller 26 is arranged inside the dispenser 2 in close proximity to a first dispensing opening 14. The roll 3 is biased against the drive roller 26 by a not-shown spring. Further biasing is achieved by a holder arrangement comprising a bottom section which is slanted towards the first dispensing opening 14. Accordingly, the roll 3 is also biased by means of gravity against the drive roller 26. Again, the drive roller 26 is frictionally engaged with the roll 3. A roll rotational axis of the roll 3 is substantially parallel to the drive roller 26. The first dispensing opening 14 is formed between the not-shown upper housing portion and the lower housing portion 10. A dispensing passage is formed between the drive roller 26 and a non-shown engaging roller arranged in the not-shown upper housing portion.

The dispenser 2 is provided with a lid 64, which is connected to the lower housing portion 10 by means of a hinge 66. The lid 64 may connect and lock to the top of the upper housing portion. The lid 64 is provided with a second dispensing opening 68. A dispensing end 32 of the web from the roll 3 is dispensed via the first and second dispensing openings 14, 68, suitably when the lid 64 is closed. (The dispensing end 32 has been illustrated partially removed to make the drive roller 26 more visible.)

Example embodiments may be combined as understood by a person skilled in the art. A portable dispenser may be provided with a lid having a second dispensing opening, the paper tissue or nonwoven material being dispensed through both the first and the second dispensing openings.

Although the invention has been described with reference to example embodiments, many different alterations, modifications and the like will become apparent for those skilled in the art. For instance the dispensing passage may be arranged at a different surface than a vertical side of the dispenser, e.g. at an underside may be an alternative location when the dispenser is to be wall mounted or at an upper side if the dispenser is to be set on a surface with its lower housing portion.

Therefore, it is to be understood that the foregoing is illustrative of various example embodiments and the invention is not to be limited to the specific embodiments disclosed and that modifications to the disclosed embodiments, combinations of features of disclosed embodiments as well as other embodiments are intended to be included within the scope of the appended claims.

As used herein, the term "comprising" or "comprises" is open-ended, and includes one or more stated features, elements, steps, components or functions but does not preclude the presence or addition of one or more other features, elements, steps, components, functions or groups thereof.

As used herein, the term "and/or" includes any and all combinations of one or more of the associated listed items.

As used herein, the common abbreviation "e.g.", which derives from the Latin phrase "exempli gratia," may be used to introduce or specify a general example or examples of a previously mentioned item, and is not intended to be limiting of such item. If used herein, the common abbreviation "i.e.", which derives from the Latin phrase "id est," may be used to specify a particular item from a more general recitation.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present.

The invention claimed is:

1. A dispenser for web of absorbent paper, tissue or nonwoven material in the form of a roll, said dispenser comprising:

a housing with a holder arrangement for receiving said roll, said holder arrangement providing a roll rotational axis about which said roll is arranged to rotate when dispensing said web, a drive roller extending in a direction substantially parallel with said roll rotational axis, said drive roller being adapted to abut said roll to control said dispensing of said web and to rotate substantially at the same peripheral speed as said roll when web is dispensed, and an engaging roller extending substantially parallel with said drive roller, wherein said drive roller and said engaging roller are arranged so as to define a dispensing passage therebetween for said dispensing of said web, and wherein said dispenser is adapted for a user to grasp, and pull on, a dispensing end of said web to dispense a length of web from said roll, wherein said roll being arranged to be biased against said drive roller by means of at least one spring to frictionally engage with said drive roller, and wherein said drive roller being arranged such that said dispensing end is adapted to be led from said roll over said drive roller, wherein said engaging roller causes said dispensing end to frictionally engage with said drive roller and said engaging roller in said dispensing passage such that said dispensing is controlled by an interaction between said dispensing end, said drive roller and said engaging roller, as said drive roller and said engaging roller are rotated by said dispensing end when said user pulls on said dispensing end, wherein said drive roller and said engaging roller each comprises large diameter longitudinal sections and small diameter longitudinal sections, each large diameter longitudinal section of the drive roller arranged between two small diameter longitudinal sections of the drive roller, and each large diameter longitudinal section of the engaging roller arranged between two small diameter longitudinal sections of the engaging roller, and wherein said drive roller and said engaging roller are arranged with the large diameter longitudinal sections of the drive roller offset from the large diameter longitudinal sections of the engaging roller such that a small diameter longitudinal section of said drive roller is opposite to a large diameter longitudinal section of said engaging roller and a large diameter longitudinal section of said drive roller is opposite to a small diameter longitudinal section of said engaging roller, and wherein said drive roller and said engaging roller are arranged at a distance from each other such that said dispensing passage defined between said rollers is undulated in the direction substantially parallel with said roll rotational axis.

2. The dispenser according to claim 1, wherein a peripheral surface of said engaging roller is arranged to be in contact only with said dispensing end of said web.

3. The dispenser according to claim1, wherein said housing comprises a first dispensing opening and said drive roller and said engaging roller are arranged in said housing such that said dispensing passage is arranged in, or in direct connection with, said first dispensing opening.

4. The dispenser according to claim 3, wherein said first dispensing opening, in a direction parallel with said roll rotational axis, is narrower than a width of said roll.

5. The dispenser according to claim 3, wherein said housing is provided with a second dispensing opening arranged downstream in a direction of dispensing at a distance from said first dispensing opening.

6. The dispenser according to claim 5, wherein said second dispensing opening is provided in a lid of said housing.

7. The dispenser according to claim 1, wherein said dispensing passage is a friction nip.

8. The dispenser according to claim 1, wherein said longitudinal sections of different diameters of said drive roller or said engaging roller are of the same widths, or of different widths.

9. The dispenser according to claim 1, wherein said drive roller at its two outer ends comprises an outer surface portion with a lower coefficient of friction than the coefficient of friction of a central surface portion of the drive roller.

10. The dispenser according to claim 1, wherein said drive roller and/or said engaging roller comprise/s an outer surface portion made from a rubber or rubberlike material.

11. The dispenser according to claim 1, wherein said drive roller extends over a distance parallel with said roll rotational axis shorter than a width of said roll.

12. The dispenser according to claim 1, wherein said drive roller and/or said engaging roller are/is provided with a one-way bearing for controlling a direction of rotation of said drive roller and/or said engaging roller.

13. The dispenser according to claim 1, wherein said drive roller is provided with a braking arrangement for controlling a speed of rotation of said drive roller to prevent overspin of said roll.

14. The dispenser according to claim 1, wherein said dispenser is a portable dispenser.

15. The dispenser according to claim 1, wherein a large diameter longitudinal section of the drive roller protrudes into a space between two adjacent large diameter longitudinal sections of the engaging roller.

16. The dispenser according to claim 1, wherein a large diameter longitudinal section of the engaging roller protrudes into a space between two adjacent large diameter longitudinal sections of the drive roller.

17. The dispenser according to claim 1, wherein the small diameter longitudinal sections and the large diameter longitudinal sections of the drive roller and the engaging roller are disc shaped.

* * * * *